US008725047B2

(12) United States Patent
Kudo

(10) Patent No.: US 8,725,047 B2
(45) Date of Patent: May 13, 2014

(54) IMAGE FORMING APPARATUS

(75) Inventor: Yoshiki Kudo, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 307 days.

(21) Appl. No.: 13/164,848

(22) Filed: Jun. 21, 2011

(65) Prior Publication Data

US 2012/0003018 A1 Jan. 5, 2012

(30) Foreign Application Priority Data

Jun. 30, 2010 (JP) ..... 2010-149377

(51) Int. Cl.
*G03G 15/14* (2006.01)

(52) U.S. Cl.
USPC ..... 399/310; 399/121; 399/313

(58) Field of Classification Search
USPC ..... 399/121, 297, 299, 302, 303, 310, 313
See application file for complete search history.

(56) References Cited

U.S. PATENT DOCUMENTS

| | | | | |
|---|---|---|---|---|
| 8,437,670 | B2 * | 5/2013 | Katagiri et al. | 399/310 |
| 2009/0196663 | A1 * | 8/2009 | Yasumaru et al. | 399/308 |
| 2009/0202281 | A1 * | 8/2009 | Doda et al. | 399/313 |

FOREIGN PATENT DOCUMENTS

| | | | |
|---|---|---|---|
| JP | 11-143249 | A | 5/1999 |
| JP | 3388535 | B2 | 3/2003 |
| JP | 2009-48051 | A | 3/2009 |

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image forming apparatus includes an image bearing member that carries a toner image, a rotatable endless belt facing the image bearing member, and a transfer device arranged on an inner peripheral side of the belt and transferring a toner image from the image bearing member to the belt. The transfer device includes a sheet member having conductivity and having a free end and an opposite end which is fixed. In addition, a support member supports and contacts the sheet member, and a securing member secures the sheet member. The sheet member at least has a first region secured by the securing member, a second region in contact with the support member, a third region separated from the support member and the belt, and a fourth region separated from the support member and in contact with the belt. The first region, the second region, the third region and the fourth region are located in order from an upstream side toward a downstream side in a rotational direction of the belt.

14 Claims, 4 Drawing Sheets

IMAGE FORMING APPARATUS

BACKGROUND OF THE INVENTION

1. Field of the Invention

The present invention relates to an image forming apparatus in which a toner image is transferred to a transfer material.

2. Description of the Related Art

There are known image forming apparatuses including a primary transfer device that electrostatically transfers a toner image carried on a surface of an image bearing member to a belt. As an example of such primary transfer device, there is a known device including a transfer member that forms a transfer electric field while being rubbed against a belt in a secured state as opposed to a device that rotates like a primary transfer roller. Japanese Patent Application Laid-Open No. H11-143249 discloses an invention relating to such type of primary transfer device.

The invention disclosed in Japanese Patent Application Laid-Open No. H11-143249 relates to a primary transfer device including a sheet-like conductive member that is in contact with a belt, a PET film that supports a back surface of the conductive member, and a support member that supports a lower end of the PET film. Upon application of a bias to the conductive member, an electric field for transfer is formed between a photosensitive drum and the conductive member. With such configuration, the electric field makes a toner image on a surface of the photosensitive drum be transferred to a transfer material transported by the belt, thereby an image being formed.

However, in the invention disclosed in Japanese Patent Application Laid-Open No. H11-143249, the conductive member and the PET film have different coefficients of thermal expansion, resulting in the conductive member having an undulating shape in a longitudinal direction (direction parallel to the direction of the axis of the photosensitive drum). This phenomenon will be described more specifically for a case where the coefficient of thermal expansion of the support member is smaller than that of the PET film. When the temperature of the inside of the image forming apparatus main body increases, the support member and the PET film thermally expand. When the PET film and the support member are secured to each other, the PET film is pulled by the support member, thereby suppressing the expansion of the PET film. In a region in which the PET film and the support member are bonded to each other and a region in which the PET film and the support member are not bonded to each other, the PET film has different thermal expansion amounts. Accordingly, the PET film undulates in the longitudinal direction at the boundary between the PET film and the support member.

Because of the bond to the PET film, the conductive member undulates together with the PET film. As described above, the undulating phenomenon of the conductive member occurs due to the differences of the coefficient of thermal expansion among the conductive member, the PET film and the support member. Therefore, where the relationship in magnitude of the coefficients of thermal expansion is opposite to that in the aforementioned case, a similar phenomenon also occurs. When the conductive member undulates, unevenness occurs in the state of contact between the conductive member and the belt in the longitudinal direction (direction parallel to the direction of the axis of the photosensitive drum). Compared to a part in a close contact state, in a part in a loose contact state, the contact resistance between the conductive member and the belt increases. Consequently, unevenness occurs in supply of charge from the conductive member, resulting in uneven images.

SUMMARY OF THE INVENTION

In view of the aforementioned circumstances, the present invention provides an image forming apparatus enabling suppression of uneven images by making a charge applied from a conductive member to a belt uniform in a direction parallel to a direction of an axis of an image bearing member.

The present invention provides an image forming apparatus including: an image bearing member that carries a toner image; a rotatable endless belt facing the image bearing member; and a transfer device arranged on an inner peripheral side of the belt and transferring a toner image from the image bearing member to the belt, the transfer device including a sheet member having conductivity, a separated portion including a fixed end on an upstream side in a rotational movement direction of the belt and being spaced from the belt, and a contact portion including a free end on a downstream side in the rotational movement direction of the belt and being in contact with the belt, a support member supporting the separated portion of the sheet member, and a pressing member pressing the support member toward the sheet member, wherein, where a position being most upstream in the contact portion in the rotational movement direction of the belt is a first position, and where a position being most downstream in a region of the separated portion supported by the support member in the rotational movement direction of the belt is a second position, the support member is arranged relative to the sheet member such that a region between the first position and the second position of the sheet member is in contact with neither the belt nor the support member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereinafter, exemplary modes for carrying out the present invention will be described in details based on embodiments, with reference to the drawings. However, the dimensions, materials, shapes, the relative positions, etc., of components described in the embodiments may arbitrarily be changed depending on the configuration of the apparatus to which the present invention is applied and/or various conditions, and thus, are not intended to limit the scope of the invention to those described in the embodiments unless otherwise specifically stated.

Embodiment 1

Figure 1:
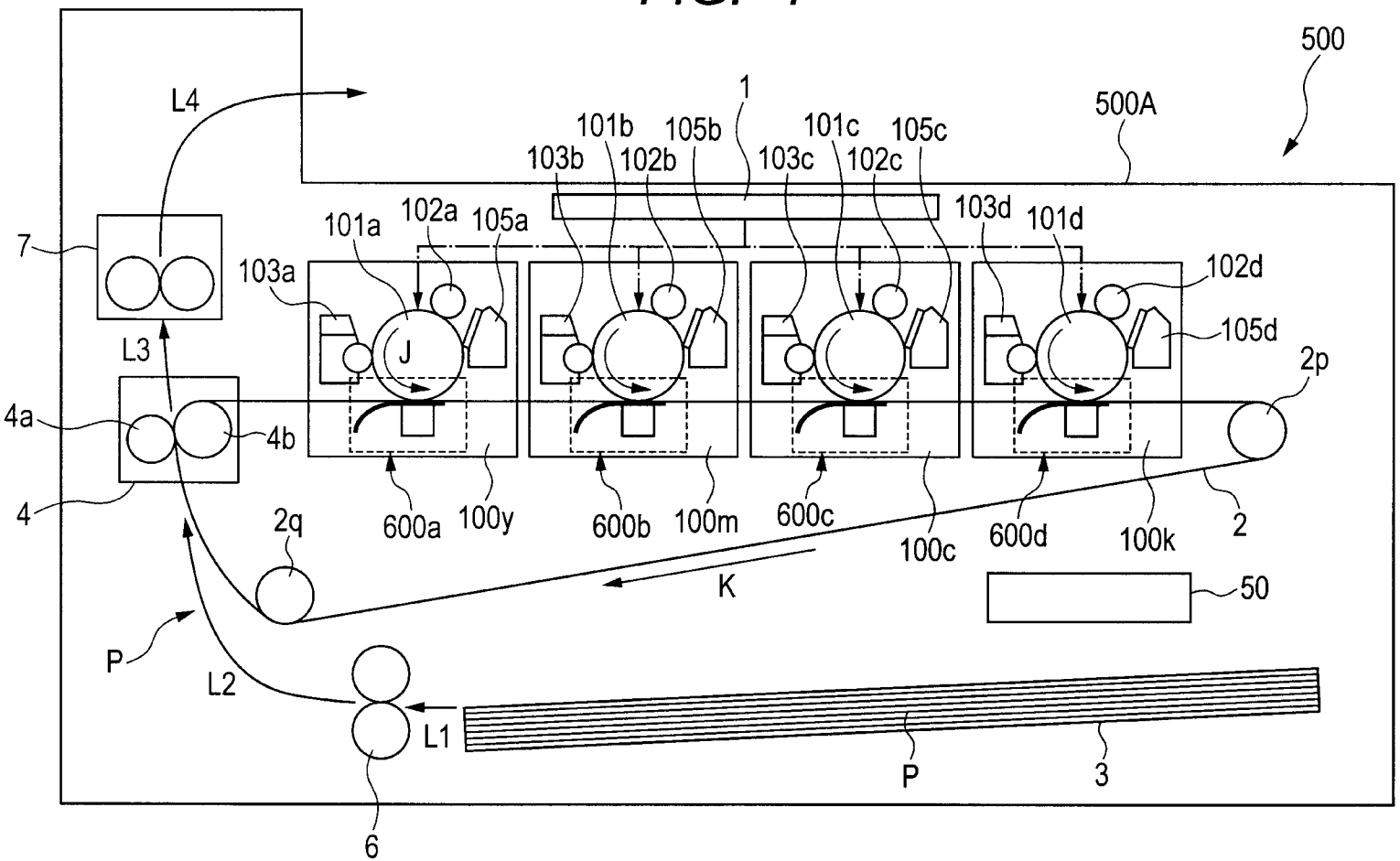
FIG. 1 is a cross-sectional diagram illustrating a configuration of an image forming apparatus according to embodiment 1 of the present invention.

FIG. 1 is a cross-sectional diagram illustrating a configuration of an image forming apparatus 500 according to embodiment 1 of the present invention.

The image forming apparatus 500 employs an electrophotographic image forming process. As illustrated in FIG. 1, the image forming apparatus 500 includes an image forming apparatus main body (hereinafter simply referred to as "apparatus main body") 500A, and a plurality of cartridges 100*y*, 100*m*, 100*c* and 100*k*, which is removable from the apparatus main body 500A.

The image forming apparatus 500 includes four different image forming stations for different colors. In each station, the removable cartridge 100 for the respective colors (the yellow cartridge 100*y*, the magenta cartridge 100*m*, the cyan cartridge 100*c* or the black cartridge 100*k*) is mounted. Since the image forming process and the configuration of the inside of the cartridge 100 are the same for all the colors, a description of the yellow cartridge 100*y* will be provided below as a representative example.

A photosensitive drum 101*a*, which is an image bearing member that carries a toner image, is driven to rotate in the direction of arrow J at a predetermined peripheral speed. During the course of the rotation, first, a surface of the photosensitive drum 101*a* is uniformly charged by a charge roller 102*a*. Next, the surface of the photosensitive drum 101*a* is selectively exposed by an exposure device 1. As a result, an electrostatic latent image is formed on the surface of the photosensitive drum 101*a* by the exposure device. Next, the electrostatic latent image is developed by using toner in a developing device 103*a* and thereby becomes a visible image.

The developed toner image is electrostatically transferred onto an intermediate transfer belt 2 by a primary transfer device 600*a*. The primary transfer device 600*a* forms a transfer unit jointly with the photosensitive drum 101*a* via the intermediate transfer belt 2. The configurations of primary transfer devices 600*b*, 600*c* and 600*d* in the other image forming stations are the same as that of the transfer device 600*a*, and thus, a description thereof will be omitted.

After the transfer of the toner image onto the intermediate transfer belt 2, toner remaining on the photosensitive drum 101 without being transferred is scraped out by a cleaning device 105*a*. Subsequently, the process returns to charging by the charge roller 102*a*. The series of processes are performed in the yellow cartridge 100*y*, the magenta cartridge 100*m*, the cyan cartridge 100*c* and the black cartridge 100*k* in the respective stations, and toner images for the respective colors are sequentially superimposed on the front surface of the intermediate transfer belt 2. Since photosensitive drums 101*b* to 101*d*, charge rollers 102*b* to 102*d*, developing devices 103*b* to 103*d* and cleaning devices 105*b* to 105*d* in the respective stations have configurations that are the same as those of the photosensitive drum 101*a*, the charge roller 102*a*, the developing device 103*a* and the cleaning device 105*a*, respectively, the description thereof will be omitted.

The intermediate transfer belt 2 is looped around support rollers 2*p* and 2*q* and an opposing roller 4*b*, and rotates in the direction of arrow K upon the support roller 2*p* or 2*q* being driven to rotate. Upon the rotation of the intermediate transfer belt 2, the composite image on the front surface of the intermediate transfer belt 2, which have been obtained as a result of the above-described process, is transported between a secondary transfer roller 4*a* and the opposing roller 4*b* included in a secondary transfer unit 4.

Transfer materials P are fed and transported one by one from a feed cassette 3 in the direction of arrow L1 by a non-illustrated transport roller. A transfer material P is transported in the direction of arrow L2 by registration rollers 6. Simultaneously with arrival of the toner image on the intermediate transfer belt 2 at the secondary transfer unit 4, the transfer material P arrives at the secondary transfer unit 4, too. After the arrival of the transfer material P at the secondary transfer unit 4, the transfer material P is pinched and transported between the secondary transfer roller 4*a* and the intermediate transfer belt 2. At that moment, a bias with a polarity opposite to that of the toner is applied to the secondary transfer roller 4*a*, thereby the toner image on the intermediate transfer belt 2 being electrostatically transferred to a surface of the transfer material P. Subsequently, the transfer material P carrying the toner image is transported in the direction of arrow L3 and passes through a fixing device 7. Inside the fixing device 7, the toner image is subjected to heating and pressure application, and thereby fused with the colors mixed, and fixed to the transfer material P. Subsequently, the transfer material P is transported in the direction of arrow L4, and discharged to the outside of the apparatus main body 500A. Through the above-described process, a full-color image is formed on the transfer material P.

Inside the apparatus main body 500A, a controller 50, which is a control unit, is provided. The controller 50 controls driving of components inside the apparatus main body 500A, for example, the photosensitive drums 101, the charge rollers 102, the exposure device 1, the developing devices 103, and the primary transfer devices 600.

Figure 2:
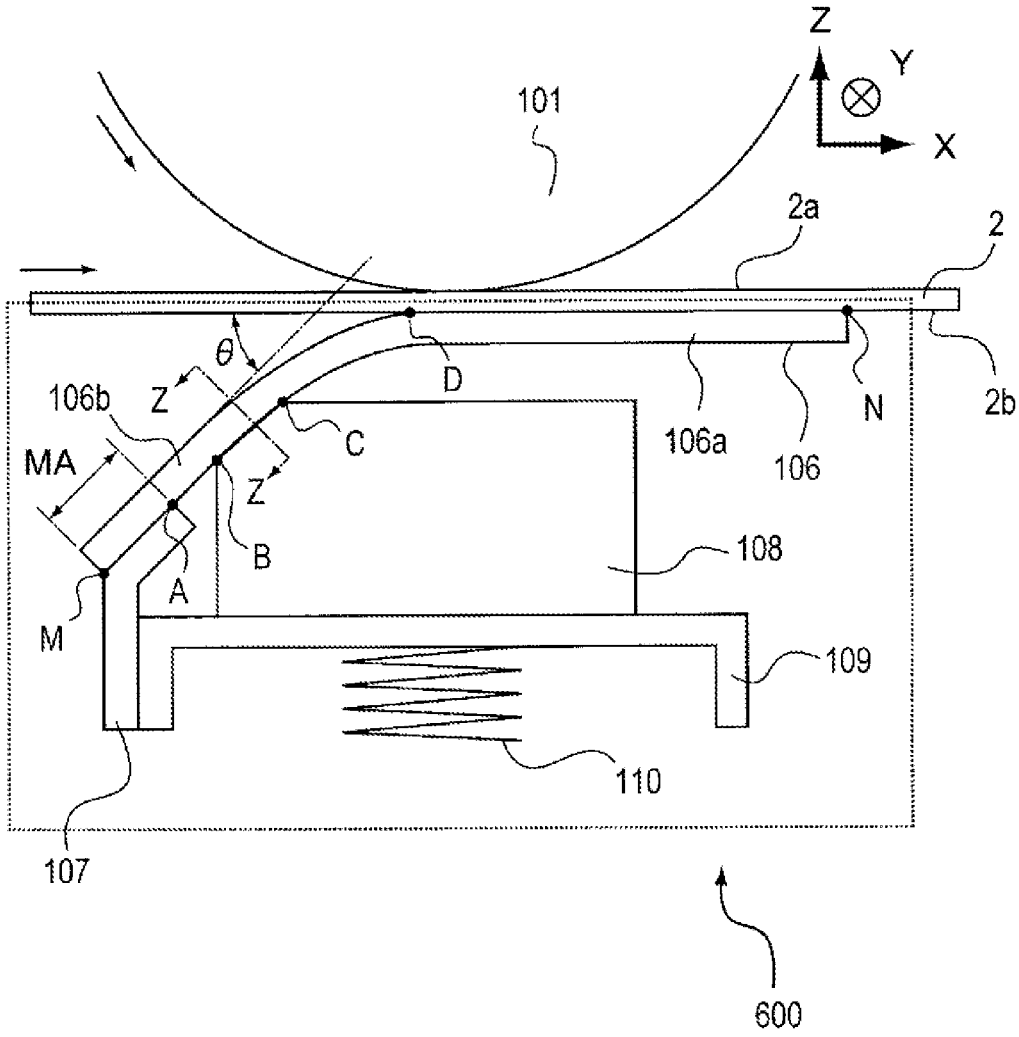
FIG. 2 is an enlarged cross-sectional diagram illustrating a configuration of a primary transfer device.

FIG. 2 is an enlarged cross-sectional diagram illustrating a configuration of a primary transfer device 600. As illustrated in FIG. 2, the intermediate transfer belt 2 is an endless belt. The intermediate transfer belt 2 includes a front surface 2*a*, which is a first surface opposing the photosensitive drum 101, and a back surface 2*b*, which is a second surface on the opposite side of the front surface 2*a*. The intermediate transfer belt 2 is a rotatable belt looped around the aforementioned support rollers 2*p* and 2*q* (see FIG. 1) and the opposing roller 4*b* (see FIG. 1).

The primary transfer device 600 included in a primary transfer unit includes a sheet member 106. The photosensitive drum 101 and the intermediate transfer belt 2 move while rotating in contact with each other. At a position facing the photosensitive drum 101, the intermediate transfer belt 2 is arranged, and a position facing the back surface 2*b* of the intermediate transfer belt 2, the sheet member 106 is arranged in a stationary state.

The sheet member 106, which is a conductive member, has a sheet-like shape, extends in a direction (Y direction) parallel to a direction of an axis of the photosensitive drum 101, and has conductivity. The sheet member 106 includes an inclined portion 106*b* and a flat portion 106*a*. In the following description, "upstream" or "downstream" refers to upstream or downstream in a rotational movement direction X of the intermediate transfer belt 2. A Y direction refers to a direction from a front surface toward a back surface of FIG. 2.

The inclined portion 106*b*, which is a separated portion, is a portion facing the back surface 2*b* of the intermediate transfer belt 2 and spaced from the intermediate transfer belt 2. The inclined portion 106*b* includes an end portion (region MA) as a fixed end on the upstream side in the rotational movement direction X of the intermediate transfer belt 2. The inclined portion 106*b* forms an inclination angle θ with the intermediate transfer belt 2.

The flat portion 106*a*, which is a contact portion, is a portion in contact with the intermediate transfer belt 2. The flat portion 106*a* includes another end portion (position N) as a free end on the downstream side in the rotational movement direction X of the intermediate transfer belt 2. The flat portion 106*a* is in contact with the intermediate transfer belt 2, and extends in a direction along a surface of the intermediate transfer belt 2.

The primary transfer device 600 includes a securing base 109 with a support member 108 and a sheet securing member 107 secured thereto. The securing base 109 supports the support member 108 and the sheet securing member 107. The securing base 109 is formed of a metal plate. The sheet securing member 107 may be formed integrally with the securing base 109 or may also be formed separately and fastened to the securing base 109 via, e.g., screws with good precision.

The primary transfer device 600 also includes the aforementioned sheet securing member 107 for securing the sheet member 106. The sheet securing member 107, which is a securing member, is arranged upstream of the below-described support member 108 in the rotational movement direction X of the intermediate transfer belt 2. The end portion (region MA) of the inclined portion 106*b* of the sheet member 106 on the upstream side in the rotational movement direction X of the intermediate transfer belt 2 is secured as a fixed end to the sheet securing member 107 by means of bonding. The sheet securing member 107 is formed of a metal plate.

The primary transfer device 600 includes the support member 108 supporting the sheet member 106. The support member 108 is a member slidably supporting a back surface of the inclined portion 106*b* of the sheet member 106. The sheet member 106 abuts on the intermediate transfer belt 2 by means of its own stiffness. In order to provide close contact between the sheet member 106 and the intermediate transfer belt 2, the support member 108 presses the sheet member 106. The position of the support member 108 will be described in details later.

Since the sheet member 106 abuts on the intermediate transfer belt 2 by means of its own stiffness as described above, the sheet member 106 is rubbed against the intermediate transfer belt 2 upon movement of the intermediate transfer belt 2. Because of the conductivity of the sheet member 106, upon application of a bias with a polarity opposite to that of the toner to the sheet member 106 from a non-illustrated power source, an electric field for transferring the toner on the photosensitive drum 101 to the front surface of the intermediate transfer belt 2 is formed.

The primary transfer device 600 includes a compression spring 110 attached to the back surface of the securing base 109. The compression spring 110, which is a pressing member, is a spring that biases the securing base 109 toward the intermediate transfer belt 2, and also presses the support member 108 and the sheet securing member 107 toward the intermediate transfer belt 2. Accordingly, the support member 108 and the sheet securing member 107 press the sheet member 106.

Components included in the primary transfer device 600 will be described in detail. In order to make a current flow in the primary transfer device 600, the sheet member 106 has conductivity. Here, a sheet member 106 with a thickness of 200 μm, a length on an X-Z plane of 10 mm and a depth of 230 mm is employed. The sheet member 106 exhibits a volume resistivity of $1\times10^3$ to $1\times10^4$ (Ω-cm) upon application of 50 V thereto. The volume resistivity is a value obtained by measurement using a measuring instrument, Loresta-AP MCP-T400, manufactured by Mitsubishi Petrochemical Co., Ltd., and electrodes complying with JIS-K6911. A length on an X-Z plane refers to a length in a direction perpendicular to the direction of the axis of the photosensitive drum 101 (the same applies to the below description).

The intermediate transfer belt 2 has a thickness of 80 μm and exhibits a volume resistivity of $1\times10^{10}$ (Ω-cm) upon application of 500 V thereto. Employment of such sheet member 106 and intermediate transfer belt 2 enables a bias applied to the primary transfer unit to be suppressed to around 300 V.

The details are described below. A voltage is supplied to a contact point in the secured region (region MA) of the sheet member 106 in FIG. 2 by a non-illustrated power supply apparatus. Accordingly, a part between positions A and D of the sheet member 106 has a resistive component of approximately $1\times10^3$ to $1\times10^4$Ω depending on the fact that the length between positions A and D in the length of 10 mm on the X-Z plane of the sheet member 106 is 4 mm, as well as the thickness, the depth and the volume resistivity of the sheet member 106.

Since a region of contact (region ND) between the intermediate transfer belt 2 and the sheet member 106 has a length on the X-Z plane of 4 mm, a depth of 230 mm and a thickness of 80 μm, the resistive component of the intermediate transfer belt 2 in the region has a value of around $8\times10^6$Ω. Comparing both of the resistive components, the resistive components are different from each other by three digits, and thus, the resistive component of the sheet member 106 can be ignored relative to the resistive component of the intermediate transfer belt 2.

Since a current of around 5 μA is required for transfer, a voltage drop of 40 V is caused by the sheet member 106 and the intermediate transfer belt 2. Here, an exposed part of the photosensitive drum 101 has a potential of −100 V, and therefore, if a bias of 300 V is applied by the non-illustrated power supply, a potential difference of 360 V occurs between the intermediate transfer belt 2 and the photosensitive drum 101. This potential difference is sufficient for transferring toner on the photosensitive drum 101. In other words, use of the sheet member 106 and the intermediate transfer belt 2 enables an applied bias to be suppressed to around 300 V. Since the sheet member 106 has a small volume resistivity, an electrostatic adhesion force between the sheet member 106 and the intermediate transfer belt 2 is decreased. Thus, a frictional force between the same decreases, enabling suppression of a torque of the intermediate transfer belt 2.

For the sheet member 106, for example, ultrahigh molecular weight polyethylene may be used. However, a sheet whose base material itself, such as polycarbonate, PVDF, PET, polyimide, polyethylene or polyamide, has conductivity may be used as long as the material meets the above-described conditions. Otherwise, a sheet obtained by coating surfaces of an insulating sheet with a conductive material may be used.

The support member 108 employs insulating urethane foam sponge. The support member 108 exhibits a hardness of 20 to 40 degrees at 0.5 N with an Asker type C durometer. An Asker type C durometer, which is one of the durometers (spring-type hardness scales) complying with SRIS0101 (the standards provided by the Society of Rubber Industry, Japan), is a measuring instrument for hardness measurement. For the shape of the support member 108, one with a rectangular parallelepiped (with a width of 4 mm, a height of 2 mm and a depth of 230 mm) is employed.

A first position D is a position of an end portion being most upstream in the flat portion 106*a* in the rotational movement direction X of the intermediate transfer belt 2. Accordingly, the first position D corresponds to a position on the upstream side of the region (region ND) of contact between the sheet member 106 and the intermediate transfer belt 2 in the rotational movement direction X of the intermediate transfer belt 2.

A second position C is a position of an end portion being most downstream in the region BC of the inclined portion 106*b* supported by the support member 108 in the rotational movement direction X of the intermediate transfer belt 2. In other words, the second position C corresponds to a position on the downstream side of the region BC of contact between the sheet member 106 and the support member 108 in the rotational movement direction X of the intermediate transfer belt 2.

The third position B is a position of an end portion being most upstream in the region BC of the inclined portion 106*b* supported by the support member 108 in the rotational movement direction X of the intermediate transfer belt 2. In other words, the third position B corresponds to a position on the upstream side of the region BC of contact with the sheet member 106 and the support member 108 in the rotational movement direction X of the intermediate transfer belt 2.

A fourth position A is a position of an end portion being most downstream in the region MA of the inclined portion 106*b* secured by the sheet securing member 107 in the rotational movement direction X of the intermediate transfer belt 2. Accordingly, the fourth position A corresponds to a position of a boundary between the region MA, which is the secured region of the sheet member 106, and a region NA, which is a non-secured region. A position M is a position of an end portion being most upstream in the region MA of the inclined portion 106*b* secured by the sheet securing member 107 in the rotational movement direction X of the intermediate transfer belt 2. The position N is a position of an end portion being most downstream in the flat portion 106*a* in the rotational movement direction X of the intermediate transfer belt 2.

A region CD between the first position D and the second position C in the sheet member 106 is a region arranged in such a manner that the region CD in contact with neither the intermediate transfer belt 2 nor the support member 108.

The region BC between the second position C and the third position B in the sheet member 106 is a region pressed by the support member 108. Upon the compression spring 110 pressing the securing base 109 toward the intermediate transfer belt 2, the securing base 109 presses the sheet securing member 107 and the support member 108 toward the sheet member 106. Thus, the support member 108 presses the region BC between the second position C and the third position B in the sheet member 106.

A region AB between the third position B and the fourth position A in the sheet member 106 is a region arranged in such a manner that the region AB is in contact with none of the intermediate transfer belt 2, the support member 108 and the sheet securing member 107.

As described above, the sheet member 106, the support member 108 and the sheet securing member 107 are arranged in such a manner that the fourth position A, the third position B, the second position C and the first position D are arranged in this order from the upstream side in the rotational movement direction X of the intermediate transfer belt 2. Consequently, the non-contact region CD, which is in contact with neither the support member 108 nor the intermediate transfer belt 2, is ensured in the sheet member 106. The effects of this positional relationship will be described below.

Image unevenness can be considered to occur due to uneven charge supply from the sheet member 106 to the intermediate transfer belt 2. The uneven charge supply occurs as a result of the undulating shape of the sheet member 106 making the contact between the sheet member 106 and the intermediate transfer belt 2 uneven in the longitudinal direction (direction parallel to the direction of the axis of the photosensitive drum 101). In other words, for stable charge supply to the intermediate transfer belt 2, it is necessary to make the contact between the sheet member 106 and the intermediate transfer belt 2 uniform throughout the entire contact region. The undulation of the sheet member 106 occurs at the portion of contact between the sheet member 106 and the sheet securing member 107. Thus, in order to make the contact between the sheet member 106 and the intermediate transfer belt 2 uniform throughout the contact region, it is necessary to suppress undulation of a portion of the sheet member 106 upstream of the first position D in the rotational movement direction X of the intermediate transfer belt 2. Accordingly, the region between the positions B and C of the sheet member 106 is pressed by the compression spring 110 via the support member 108, and the region between the positions C and D, which is downstream of the region between the positions B and C in the rotational movement direction X of the intermediate transfer belt 2, is made to be in non-contact state.

Figure 3:
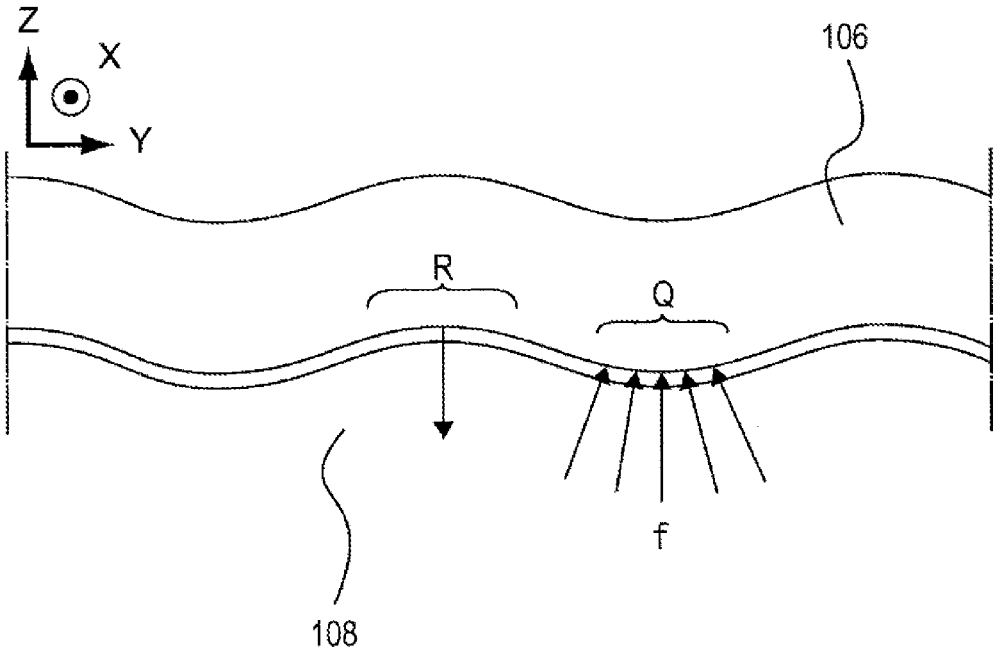
FIG. 3 is an enlarged cross-sectional diagram illustrating a state of a contact interface at a position of contact between a sheet member and a support member.

FIG. 3 is an enlarged cross-sectional diagram illustrating a state of a contact interface at a position of contact between the sheet member 106 and the support member 108. As illustrated in FIG. 3, while the sheet member 106 undulates, the shape of the support member 108 follows the undulation. It is assumed that a side of the sheet member 106 that is in contact with the support member 108 is a back surface and a side opposite thereto is a front surface. In this case, when a projection portion Q projecting from the back surface of the sheet member 106 is pressed by the support member 108 as a result of being subject to a force f, a recess portion R seeks to move in the Y direction owing to a component force in the Y direction of the force f. However, because of presence of the support member 108 at its opposing position, the sheet member 106 cannot deform in the Y direction. In other words, the undulation of the sheet member 106 is not suppressed by pressing by the support member 108 alone.

However, since there is the region CD in which the sheet member 106 is in contact with neither the intermediate transfer belt 2 nor the support member 108 (see FIG. 2), which is located at a downstream end of the region of contact between the sheet member 106 and the support member 108, the sheet member 106 can move in the Y direction. Consequently, the undulation of the sheet member 106 is suppressed. From the reason described above, provision of the region BC in which the sheet member 106 is pressed by the support member 108 and provision of the region CD in which the sheet member 106 is not in contact with any component adjacent to the region BC are effective to reduce the undulation.

In order to employ such configuration, a material with a Young's modulus of 1500 to 2500 MPa for the sheet member 106 and a material with a hardness of no less than 20 degrees at 0.5 N with an Asker type C durometer are selected for the support member 108, respectively. If the sheet member 106 has a Young's modulus smaller than the aforementioned range or the support member 108 has a hardness smaller than the aforementioned value, the point C is located downstream of the point D, and thus, the undulation of the sheet member 106 is not suppressed. If the sheet member 106 has a Young's modulus higher than the aforementioned range, the sheet member 106 does not easy deform, resulting in an increase in pressure required for eliminating the undulation. An increase in pressure of the compression spring 110 leads to an increase in pressure of the sheet member 106 applied to the intermediate transfer belt 2, raising the torque of the intermediate transfer belt 2. Accordingly, the material with a Young's modulus higher than the aforementioned range is not practically employed.

According to the configuration of embodiment 1, the region BC in which the back surface of the sheet member 106 is pressed and the region CD in which the back surface of the sheet member 106 is in contact with neither the intermediate transfer belt 2 nor the support member 108 are provided between the fixed end and the free end of the sheet member 106. Accordingly, a pressing force on the pressed region BC is transmitted to the non-contact region CD, suppressing undulation in the non-contact region CD. Since the non-contact region CD is stretchable, undulation can be suppressed. Accordingly, in the sheet member 106 and the intermediate transfer belt 2, supply of charge to the intermediate transfer belt 2 is made to be uniform in a direction parallel to the direction of the axis of the photosensitive drum 101, and uneven is suppressed.

More specifically, undulation of the sheet member 106, which is a cause of image irregularities, is attributable to securing the sheet member 106 and the sheet securing member 107 to each other. In the above-described configuration, the region BC in which the support member 108 slidably presses the sheet member 106 (in a non-bonded state) is provided on the side close to the sheet securing member 107. Furthermore, the non-contact region CD in which the sheet member 106 is not in contact with any other components is provided adjacent to the region BC. Provision of the regions BC and CD suppresses the undulation of the sheet member 106, which leads to suppressing uneven and image irregularities.

The support member 108 presses the region BC between the second position C and the third position B of the sheet member 106. Accordingly, a force suppressing undulation of the sheet member 106 exerts on the region BC between the second position C and the third position B of the sheet member 106. The force suppressing undulation is transmitted to the region CD between the first position D and the second position C of the sheet member 106. Consequently, undulation of the region CD between the first position D and the second position C of the sheet member 106 is further suppressed. The region BC between the second position C and the third position B of the sheet member 106 stretches and contracts based on thermal change while being rubbed against the support member 108.

The region AB between the third position B and the fourth position A of the sheet member 106 is arranged in such a manner that the region AB is in contact with none of the intermediate transfer belt 2, the support member 108 and the sheet securing member 107. Consequently, the region AB between the third position B and the fourth position A of the sheet member 106 is not held, and thus, undulation of the sheet member 106 is relieved in this region, too. The degree of undulation suppression in the region AB is not so much as that of the region CD.

Although the image forming apparatus using an intermediate transfer belt 2 has been described here, the present invention is not limited to the configuration of the present embodiment. In other words, the present invention can be applied to an image forming apparatus using a transport belt for transporting a transfer material P instead of the intermediate transfer belt 2, in which the transfer material P is made to pass between the photosensitive drum 101 and the transport belt to transfer a toner image directly to the transfer material P. Furthermore, use of the primary transfer device 600 according to embodiment 1 in such image forming apparatus enables provision of an effect similar to that of embodiment 1.

Embodiment 2

The present embodiment is the same as the image forming apparatus 500 according to embodiment 1 except change of the primary transfer device 600 in each station to primary transfer devices 700. Therefore, the primary transfer device 700, which is a point of difference from embodiment 1, will be described with reference to FIG. 4.

Figure 4:
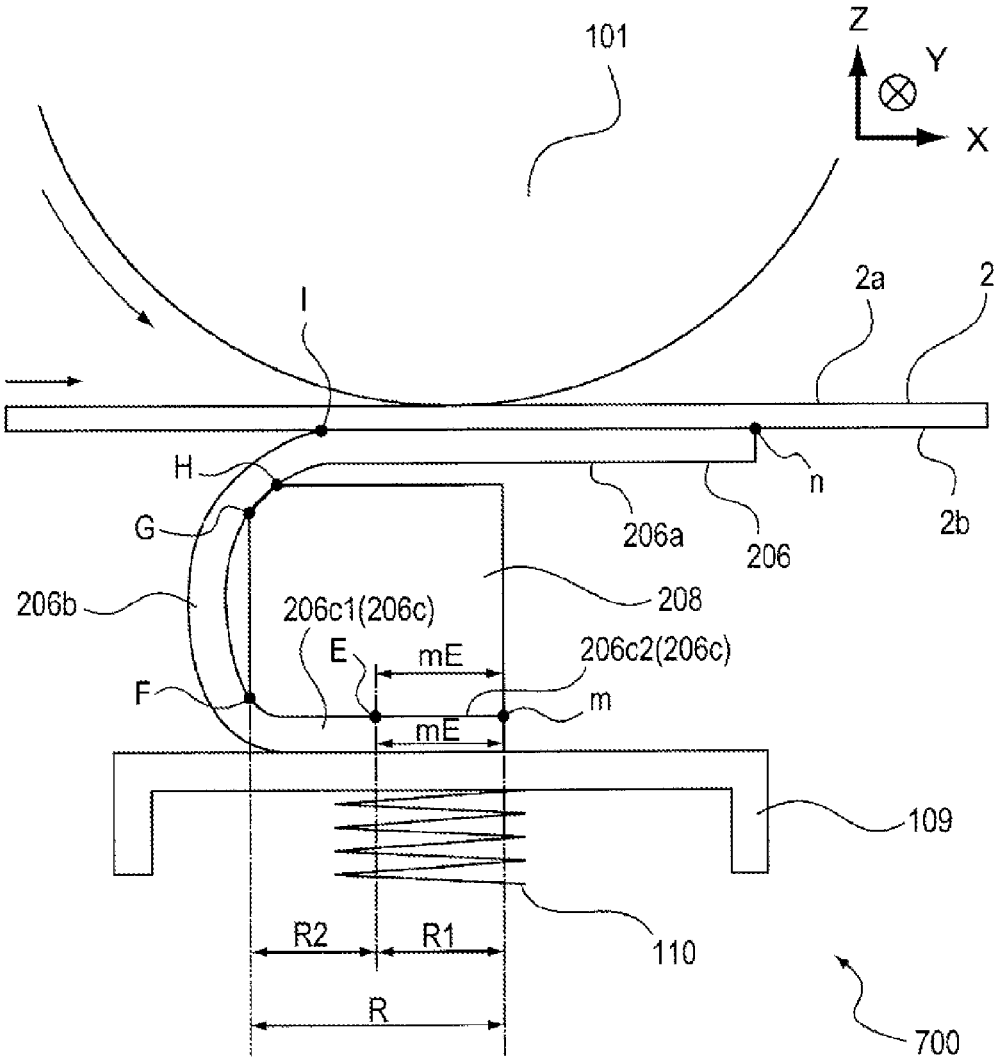
FIG. 4 is a cross-sectional diagram illustrating a configuration of a primary transfer device included in an image forming apparatus according to embodiment 2.

FIG. 4 is a cross-sectional diagram illustrating a configuration of a primary transfer device 700 included in an image forming apparatus according to embodiment 2. Components of the primary transfer device 700 according to the embodiment 2 that are the same as those of the primary transfer device 600 according to embodiment 1 are provided with the same reference numerals and a description of such components and effects thereof will be omitted as appropriate. Since embodiment 2 can be applied to an image forming apparatus similar to that of embodiment 1, a description of the image forming apparatus will be omitted. The primary transfer device 700 according to embodiment 2 is different from the primary transfer device 600 according to embodiment 1 in the following points. While in embodiment 1, the sheet member 106 includes the pressed region BC and the non-contact region CD, in embodiment 2, a sheet member includes a pressed region GH and a non-contact region HI, as well as a pressed region EF and a non-contact region FG.

As illustrated in FIG. 4, the intermediate transfer belt 2 includes a front surface 2, which is a first surface, and a back surface 2*b*, which is a second surface. On the back surface 2*b* side of the intermediate transfer belt 2, a sheet member 206 is arranged. The sheet member 206, which is a conductive member, has a sheet-like shape, extends in a direction parallel to a direction of an axis of a photosensitive drum 101 and has conductivity. The sheet member 206 has a U-shape in cross section.

The sheet member 206 faces the back surface 2*b*, which is the second surface of the intermediate transfer belt 2. The sheet member 206 includes a curved portion 206*b* and a second flat portion 206*c* (a slide portion 206*c*1 and a fixed end portion 206*c*2), which form a separated portion including one end portion (region mE) as a fixed end portion on the upstream side in a rotational movement direction X of the intermediate transfer belt 2, the separated portion being spaced from the intermediate transfer belt 2. The curved portion 206*b* and the first flat portion 206*a* are formed in series.

The sheet member 206 includes a first flat portion 206*a* including another end (position n) as a free end on the downstream side in the rotational movement direction X of the intermediate transfer belt 2, the first flat portion 206*a* being in contact with the intermediate transfer belt 2. As described above, the first flat portion 206*a* corresponds to a part of the sheet member 206 that is in contact with the intermediate transfer belt 2.

The curved portion 206*b* corresponds to a part of the sheet member 206 that is formed in series with the first flat portion 206*a*, the part being formed so as to have a curve. The slide portion 206*c*1 corresponds to a part of the sheet member 206 that is formed in series with the curved portion 206*b*, the part being in slidable contact with a securing base 109 (in a non-bonded state). The fixed end portion 206*c*2 corresponds to a part of the sheet member 206 that is formed in series with the slide portion 206*c*1 and secured to the securing base 109. The first flat portion 206*a* is arranged on the side close to the photosensitive drum 101, while the second flat portion 206*c* is arranged on the side distant from the photosensitive drum 101. Here, the first flat portion 206*a* and the second flat portion 206*c* are arranged in parallel to each other. The fixed end portion 206*c*2 is secured to both the support member 208 and the securing base 109 by bonding at the region mE. The slide portion 206*c*1 is bonded to neither the support member 208 nor the securing base 109 at the region EF.

The primary transfer device 700 includes a support member 208. The support member 208 is arranged inside a recess portion formed in a U-shape by the first flat portion 206*a*, the curved portion 206*b*, the slide portion 206*c*1 and the fixed end portion 206*c*2. The support member 208 is in contact with the curved portion 206*b* of the sheet member 206.

The primary transfer device 700 includes a securing base 109. A part of the sheet member 206, that is, the fixed end portion 206*c*2, is secured to the securing base 109 by bonding. The support member 208 is secured to an inner side surface of the second flat portion 206*c* inside of a curved portion of the sheet member 206.

The primary transfer device 700 includes a compression spring 110. The compression spring 110, which is a pressing member, presses the support member 208 toward the intermediate transfer belt 2. In other words, upon the compression spring 110 pressing the securing base 109 toward the intermediate transfer belt 2, the securing base 109 presses the sheet member 206 and the support member 208 toward the sheet member 206.

A downstream end portion of the second flat portion 206*c* of the sheet member 206 and a downward end surface of the support member 208 are arranged so as to align each other. A length R on an X-Z plane of the support member 208 is set to 4 mm. Each of a length R1 on the X-Z plane of a region of bonding between the second flat portion 206*c* and the securing base 109 and a length R1 on the X-Z plane of a region of bonding between the second flat portion 206*c* and the support member 208 is set to 2 mm. Each of a length R2 on the X-Z plane of a region of non-bonding between the second flat portion 206*c* and the securing base 109 and a length R2 on the X-Z plane of a region of non-bonding between the second flat portion 206*c* and the support member 208 is set to 2 mm.

A first position I is a position of an end portion being most upstream in the flat portion 206*a* in the rotational movement direction X of the intermediate transfer belt 2. The first position I of the sheet member 206 is in contact with the intermediate transfer belt 2.

A second position H is a position of an end portion being most downstream in a region of the curved portion 206*b* supported by the support member 208 in the rotational movement direction X of the intermediate transfer belt 2. The second position H in the sheet member 206 is in contact with the support member 208.

A fifth position G is a position of an end portion being most upstream in the region of the curved portion 206*b* supported by the support member 208 in the rotational movement direction X of the intermediate transfer belt 2, the position being close to the photosensitive drum 101. The fifth position G of the sheet member 206 is in contact with the support member 208.

A sixth position F is a position of an end portion being most upstream in the region of the curved portion 206*b* supported by the support member 208 in the rotational movement direction X of the intermediate transfer belt 2, the position being distant from the photosensitive drum 101. The sixth position F of the sheet member 206 is in contact with the support member 208.

The seventh position E is a position of a boundary between the slide portion 206*c*1 and the fixed end portion 206*c*2. A position m is a position of an end portion being most downstream in a region of the fixed end portion 206*c*2 of the second flat portion 206*c* secured by the securing base 109 in the rotational movement direction X of the intermediate transfer belt 2. A position n is a position of an end portion being most downstream in a flat portion 206*a* in the rotational movement direction X of the intermediate transfer belt 2.

A region HI between the first position I and the second position H of the sheet member 206 is arranged in such a manner that the region HI is in contact with neither the intermediate transfer belt 2 nor the support member 208.

A region GH between the second position H and the fifth position G of the sheet member 206 is a region pressed by the support member 208. Upon the compression spring 110 pressing the securing base 109 toward the intermediate transfer belt 2, the securing base 109 presses the second flat portion 206*c* and the support member 208 toward the sheet member 206. Thus, the region GH between the second position H and the fifth position G of the sheet member 206 is pressed.

The region FG between the fifth position G and the sixth position F of the sheet member 206 is arranged in such a manner that the region FG is in contact with neither the intermediate transfer belt 2 nor the support member 208.

The region EF between the sixth position F and the seventh position E of the sheet member 206 is slidable relative to the securing base 109 (in a non-bonded state) while being pressed by the securing base 109. As described above, in the region mE between the seventh position E and the position m, the sheet member 206 is bonded and thereby secured to both the support member 208 and the securing base 109.

Upon rotational movement of the intermediate transfer belt 2, the sheet member 206 is pulled downstream in the rotational movement direction X of the intermediate transfer belt 2 by an electrostatic adhesion force generated between the sheet member 206 and the intermediate transfer belt 2. Thus, pressure is applied to the region GH of the sheet member 206 by the support member 208, while pressure being applied to the region EF by the securing base 109.

The securing base 109 is biased from the back surface side toward the intermediate transfer belt 2 by the compression spring 110. Then, the region GH of the sheet member 206 is pressed by a biasing force of the compression spring 110 via support member 208. The sheet member 206 includes the regions FG and HI, which are not in contact with any members, immediately behind (i.e., adjacent to) the pressed regions EF and GH. Accordingly, for the reasons similar to those in embodiment 1, in the configuration in which the sheet member 206 is bonded and thereby secured to the securing base 109, undulation of the sheet member 206 is eliminated in the free regions. Furthermore, two pressed regions (the regions GH and EF) and two free regions (the regions HI and FG) adjacent thereto are provided, thereby suppressing undulation compared to the case of the sheet member 106 in embodiment 1.

In the configuration of embodiment 2, the sheet member 206 has a U-shape. Thus, for the sheet member 206, one including ultrahigh molecular weight polyethylene, which has a Young's modulus of 1500 to 2500 MPa, a thickness of 120 μm and a length on the X-Z plane of 16 mm, is employed. For the support member 208, one having a length on the X-Z plane of 4 mm, a height of 4 mm and a depth of 230 mm is employed. The sheet member 206 has a small thickness compared to embodiment 1, enabling the sheet member 206 to have a U-shape.

According to the configuration of embodiment 2, the region GH in which the back surface of the sheet member 206 is pressed and the region HI in which the back surface of the sheet member 206 is in contact with neither the intermediate transfer belt 2 nor the support member 208 are provided from the fixed end to the free end of the sheet member 206. Accordingly, a pressing force applied to the pressed region GH is transmitted to the non-contact region HI, suppressing undulation at the non-contact region HI as well as suppressing undulation of the non-contact region HI for as much as the non-contact region HI is stretchable. Therefore, in the sheet member 206 and the intermediate transfer belt 2, supply of charge to the intermediate transfer belt 2 is made to be uniform in a direction parallel to the direction of the axis of the photosensitive drum 101, and uneven is suppressed.

The support member 208 presses the region GH between the second position H and the fifth position G of the sheet member 206. Accordingly, a force suppressing undulation of the sheet member 206 exerts on the region GH between the second position H and the fifth position G of the sheet member 206. Then, the force suppressing undulation is transmitted to the region HI between the first position I and the second position H of the sheet member 206. Consequently, undulation of the region HI between the first position I and the second position H of the sheet member 206 is further suppressed. The region GH between the second position H and the fifth position G of the sheet member 206 stretches and contracts based on thermal change, while being rubbed against the support member 208.

The region FG between the fifth position G and the sixth position F of the sheet member 206 is arranged in such a manner that the region FG is in contact with none of the intermediate transfer belt 2, the support member 208 and the securing base 109. Consequently, the region FG between the fifth position G and the sixth position F of the sheet member 206 is not held, and thus, undulation of the sheet member 206 is relieved in this region, too.

The securing base 109 presses the region EF between the sixth position F and the seventh position E of the sheet member 206. Accordingly, a force suppressing undulation of the sheet member exerts on the region EF between the sixth position F and the seventh position E of the sheet member 206. The force suppressing undulation is transmitted to the region FG between the fifth position G and the sixth position F of the sheet member 206. Consequently, undulation of the region FG between the fifth position G and the sixth position F of the sheet member 206 is further suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-149377, filed Jun. 30, 2010, which is hereby incorporated by reference herein in its entirety.

What is claimed is:

1. An image forming apparatus comprising:

an image bearing member that carries a toner image;

a rotatable endless belt facing the image bearing member; and a transfer device arranged on an inner peripheral side of the belt and transferring a toner image from the image bearing member to the belt, the transfer device including a sheet member having conductivity and including a free end and an opposite end which is fixed;

a support member supporting and in contact with the sheet member; and a securing member securing the sheet member, wherein the sheet member at least has a first region secured by the securing member, a second region in contact with the support member, a third region separated from the support member and the belt, and a fourth region separated from the support member and in contact with the belt, and the first region, the second region, the third region and the fourth region are located in order from an upstream side toward a downstream side in a rotational direction of the belt.

2. The image forming apparatus according to claim 1, wherein the sheet member has a fifth region which is separated from the securing member and the support member and located between the first region and the second region.

3. The image forming apparatus according to claim 1, wherein the support member is a foam sponge.

4. The image forming apparatus according to claim 1, wherein the fourth region of the sheet member is electrostatically adhered to the belt by applying a voltage to the sheet member.

5. The image forming apparatus according to claim 1, further comprising a securing base supporting the support member.

6. The image forming apparatus according to claim 5, further comprising a pressing member pressing the support member toward the sheet member via the securing base.

7. The image forming apparatus according to claim 6, wherein the pressing member is a spring.

8. The image forming apparatus according to claim 5, wherein the securing member is supported by the securing base.

9. The image forming apparatus according to claim 5, wherein the securing member is a part of the securing base.

10. The image forming apparatus according to claim 1, wherein the first region and the second region of the sheet member are separated from the belt.

11. The image forming apparatus according to claim 1, wherein a part of the sheet member, which is on an upstream side of the fourth region in the rotational direction of the belt, is curved so as to separate from the belt.

12. The image forming apparatus according to claim 1, wherein, in the rotational direction of the belt, a downstream end portion of the fourth region is located on a downstream side of a downstream end portion of a region in which the image bearing member contacts the belt.

13. The image forming apparatus according to claim 1, wherein the belt is an intermediate transfer belt to which the toner image is primary transferred from the image bearing member.

14. The image forming apparatus according to claim 1, wherein the image bearing member has a plurality of image bearing members which respectively bear the toner image of a color different from each another.

* * * * *